US005988302A

United States Patent [19]

Sreshta et al.

[11] Patent Number: 5,988,302

[45] **Date of Patent: *Nov. 23, 1999**

[54] HARDMETAL FACING FOR EARTH BORING DRILL BIT

[75] Inventors: Harold A. Sreshta, Houston; Eric F. Drake, Pearland, both of Tex.

[73] Assignee: Camco International, Inc., Houston, Tex.

[ * ] Notice: This patent is subject to a terminal disclaimer.

[21] Appl. No.: 08/903,913

[22] Filed: Jul. 31, 1997

Related U.S. Application Data

[63] Continuation of application No. 08/559,959, Nov. 17, 1995, Pat. No. 5,653,299.

[51] Int. Cl.[6] ..... E21B 10/50

[52] U.S. Cl. ..... 175/374; 175/425; 428/557; 75/240

[58] Field of Search ..... 175/374, 375, 175/425, 435; 76/108.4; 51/295, 309; 75/236, 340; 428/557, 558, 559

[56] References Cited

U.S. PATENT DOCUMENTS

| | | | |
|---|---|---|---|
| 3,800,891 | 4/1974 | White et al. | 175/374 |
| 4,554,130 | 11/1985 | Ecer | 419/8 |
| 4,562,892 | 1/1986 | Ecer | 175/371 |
| 4,592,252 | 6/1986 | Ecer | 76/108.2 |
| 4,630,692 | 12/1986 | Ecer | 175/405.1 |
| 4,726,432 | 2/1988 | Scott et al. | 175/375 |
| 4,836,307 | 6/1989 | Keshavan et al. | 175/374 |
| 4,930,675 | 6/1990 | Bedford et al. | 228/112 |
| 5,653,229 | 8/1997 | Sreshta et al. | 175/374 |

*Primary Examiner*—Roger Schoeppel
*Attorney, Agent, or Firm*—Fletcher, Yoder & Van Someren

[57] ABSTRACT

A steel tooth rolling cutter earth boring drill bit includes a bit body with a threaded upper end for attachment to the end of a drill string, and a lower end including three legs extending downwardly from the bit body and with a rolling cutter rotatably mounted on each leg. A layer of wear resistant material is applied to a portion of each rolling cutter and comprises wear resistant particles in a substantially steel matrix. The steel matrix is integrally formed with the cutter in a rapid, solid state densification powder metallurgy (RSSDPM) process, and includes a duplex microstructure comprising from about 10 to 40 volume percent austenite and from about 60 to 90 volume percent martensite. The duplex microstructure may be achieved by incorporating a minor fraction of pure nickel and/or manganese powder in the powder mix used in the process, thereby providing nickel or manganese enrichment of the austenitic zones of the matrix.

49 Claims, 2 Drawing Sheets

HARDMETAL FACING FOR EARTH BORING DRILL BIT

This application is a Continuation of application Ser. No. 08/559,959 filed Nov. 17, 1995 now U.S. Pat. No. 5,653, 299.

BACKGROUND OF THE INVENTION

1. Field of the Invention

This invention relates to steel tooth rolling cutter drill bits utilized for drilling boreholes in the earth for the minerals mining industry.

2. Setting of the Invention

Hardmetal inlays or overlays are employed in rock drilling bits as wear and deformation resistant cutting edges and faying surfaces. These typically comprise composite structures of hard particles in a more ductile metal matrix. The hard particles may be metal carbides, such as either the cast WC/W2C eutectic or monocrystalline WC, or may themselves comprise a finer cemented carbide composite material. Often, a combination of hard particle types is incorporated in the materials design, and particle size distribution is controlled to attain desired performance under rock drilling conditions, such as disclosed in U.S. Pat. Nos. 3,800,891; 4,726,432; and 4,836,307. The matrix of these hardmetal systems may be iron, nickel, or copper based, but whether formed by weld deposition, brazing, plasma spraying, or infiltration, the matrix microstructure is invariably a solidification product. During fabrication, the hard phase(s) remain entirely or at least partially solid, but the matrix phase(s) grow from a melt during cooling and thus are limited by thermodynamic, kinetic, and heat transport constraints to narrow ranges of morphology, constituency and crystal structure.

The strongest commonly employed hardmetals in rolling cutter rock bit cutting structures are made by weld application of sintered tungsten carbide based tube metals or composite rods utilizing iron based matrix systems. These hardmetal deposits undergo heat treatment prior to use, resulting in matrices which are essentially alloy steels by chemistry. Microstructurally the matrix is comprised of tempered martensite with minor amounts of carbide precipitates and retained austenite. Any austenite in the microstructure occupies the internecine spaces between martensite lathes or plates. The intrinsic difficulty in the control of heat input during weld deposition of hardfacing overlays results in matrix variation due to alloying effects arising from melt incorporation of sintered carbide hard phase constituents as well as substrate material. Partial melting of cemented carbide constituents resulting in "blurring" of the hard phase boundaries and the incorporation of cobalt and WC particles into the matrix. As a practical matter, process control is challenged to maintain "primary" hardmetal microstructural characteristics such as constituency and volume fraction relationships of hard phases. Secondary characteristics such as matrix microstructure are derivative and cannot be readily regulated.

The advent of rapid, solid state densification powder metallurgy (RSSDPM) processing of composite structures has enabled the fabrication of hardmetal inlays/overlays which potentially include a range of compositions and microstructures not attainable by solidification. In addition, RSSDPM processing also provides more precise control of microstructural features than that attainable with fused overlays. Such fabrication methodologies for rock bits are disclosed in U.S. Pat. Nos. 4,554,130; 4,592,252; and 4,630, 692. Also disclosed therein and also in U.S. Pat. No. 4,562,892 are some preferred embodiments of drill bits with wear resistant hardmetal overlays which exploit the flexibility and control afforded by RSSDPM. Although many unique hardmetal formulations are made possible by RSSDPM, most will not be useful as rock bit hardmetal inlays because they lack the necessary balance of wear resistance, strength, and toughness. Unique RSSDPM composites can exhibit similarly unique failure progressions which disadvantage them for use in drilling service. For example, a RSSDPM "clone" of a conventional weld applied hardmetal made from 60 wt % cemented carbide pellets (30/40 mesh WC-7% Co), and 40 wt % 4620 steel powder, was found to have lower wear resistance than expected due to selective hard phase pullout caused by shear localization cracking in the matrix.

The presence of sharpened interfaces combined with the formation of ferrite "halos" around carbide pellets lead to deformation instability under high strain conditions. Even though the primary characteristics normally used to evaluate hardmetal (volume fractions, pellet hardness, matrix hardness, and porosity) were superior to conventional material, the RSSDPM clone exhibited an unexpected weakness. In another experiment, a RSSDPM formulation similar to the above example but adding a few percent of fine (7 micrometer) WC powder was intended to mimic the precipitation induced dispersion strengthening of matrix in conventional hardmetal.

However, rapid surface diffusion in the powder preform prior to hot pressing caused transformation of the fine WC to brittle eta type carbide in the final composite. In this case, an unexpected reaction led to compromise of the intended matrix strengthening mechanism.

The potential benefits of RSSDPM hardmetal inlays are thickness and microstructural uniformity, low defect and porosity levels, and stability of hard phases/hardness retention. In order to realize these benefits, special chemistry and microstructural design of the hardmetal matrix are required to provide appropriate deformation characteristics under high unit loads experienced at tooth crests.

SUMMARY OF THE INVENTION

According to the invention there is provided a steel tooth rolling cutter earth boring drill bit comprising a bit body with a threaded upper end for attachment to the end of a drill string, and a lower end comprised of a plurality of legs extending downwardly from said bit body and with a rolling cutter rotatably mounted on at least one of said legs, a layer of wear resistant material on a portion of said rolling cutter comprised of wear resistant particles in a substantially steel matrix, said steel matrix having a duplex microstructure comprising from about 10 to 40 volume percent austenite and from about 60 to 90 volume percent martensite.

In the present invention, the use of a duplex matrix microstructure comprising austenitic zones within a martensite continuum provide high strength and toughness. One way of achieving such a duplex microstructure is by incorporating a minor fraction of pure nickel and/or manganese powder in the matrix of an inlay powder mix, to promote austenite stabilization, wherein the principal matrix constituent is an alloy steel powder such as AISI 4600. Addition of these elements can help provide high strength and toughness in the matrix while inhibiting the formation of ferrite halos around WC-Co cemented carbide pellets.

During densification and carburization, inter-diffusion causes composition gradients to develop along nickel and/or manganese steel particle boundaries resulting in nickel and/or manganese rich zones with no distinct interface. After hardening, and tempering, the hardmetal matrix microstructure reflects the austenite stabilization effects of nickel and/or manganese, comprising a dispersion of nickel and/or manganese austenitic pools in a sea of tempered martensite. Austenitic zones merge into martensitic material gradually, by increasing lath density. The result is a hardmetal inlay comprised of wear resistant particles in a substantially steel matrix having a duplex microstructure comprising about 10 to 40 volume percent austenite and 60 to 90 volume percent tempered martensite.

DETAILED DESCRIPTION OF THE PREFERRED EMBODIMENTS

Figure 1:
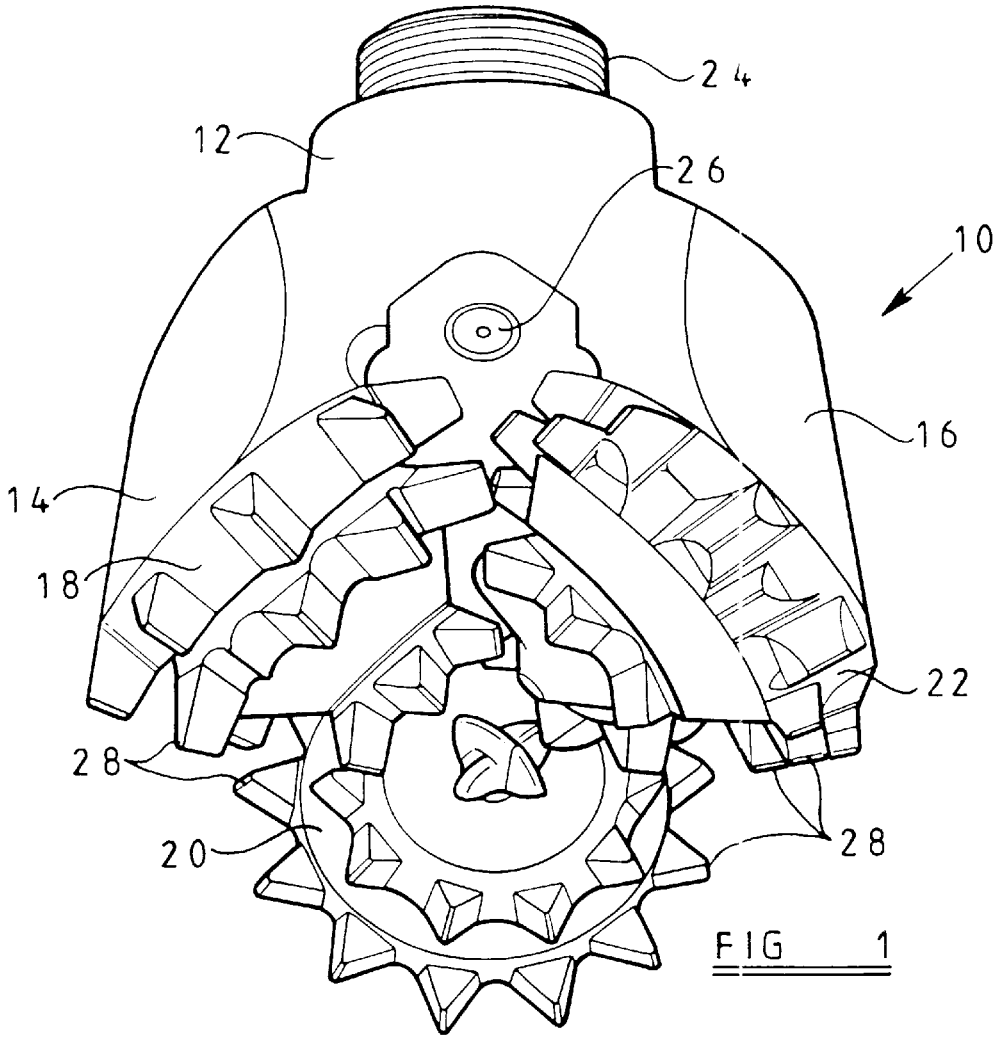
FIG. 1 shows a typical steel tooth rolling cutter earth boring drill bit.

A typical steel tooth rolling cutter drill bit is shown as numeral 10 of FIG. 1. The bit has a body 12 with three legs (only two are shown) 14, 16. Upon each leg is mounted a rolling cutter 18, 20, 22. During operation, the bit 10 is secured to drill pipe (not shown) by threads 24. The drill pipe is rotated and drilling fluid is pumped through the drill pipe to the bit 10 and exists through one or more nozzles 26. The weight of the drilling string forces the cutting teeth 28 of the cutters 18, 20, 22 into the earth, and as the bit is rotated, the earth causes the cutters to rotate upon the legs effecting a drilling action. Typically, the cutting teeth 28 are coated with some form of wear resistant material to help maintain the tooth sharpness as the bit 10 drills through the earth.

Each rolling cutter 18, 20, 22 is formed by rapid, solid state densification powder metallurgy (RSSDPM). The process involves combining steel powders and wear resistant materials in a mold and making a finished part with a two step densification process. An exemplary solid state densification process is explained in detail by Ecer in the previously referenced U.S. Pat. No. 4,562,892.

Figure 2:
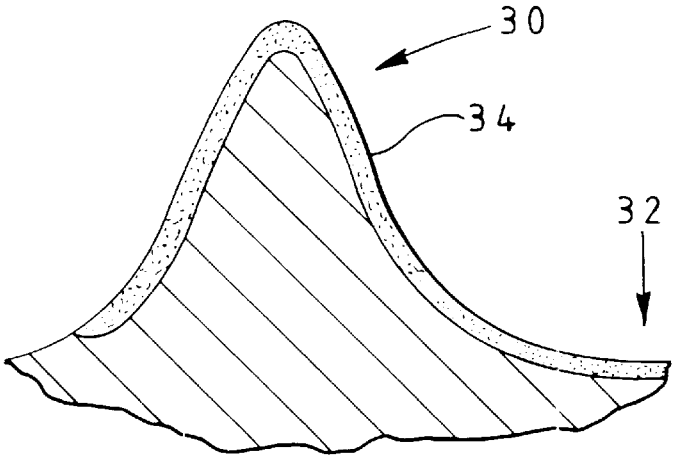
FIG. 2 shows a cross section view of a tooth and the surface of the rolling cutter of a drill bit of the present invention.
Figure 3:
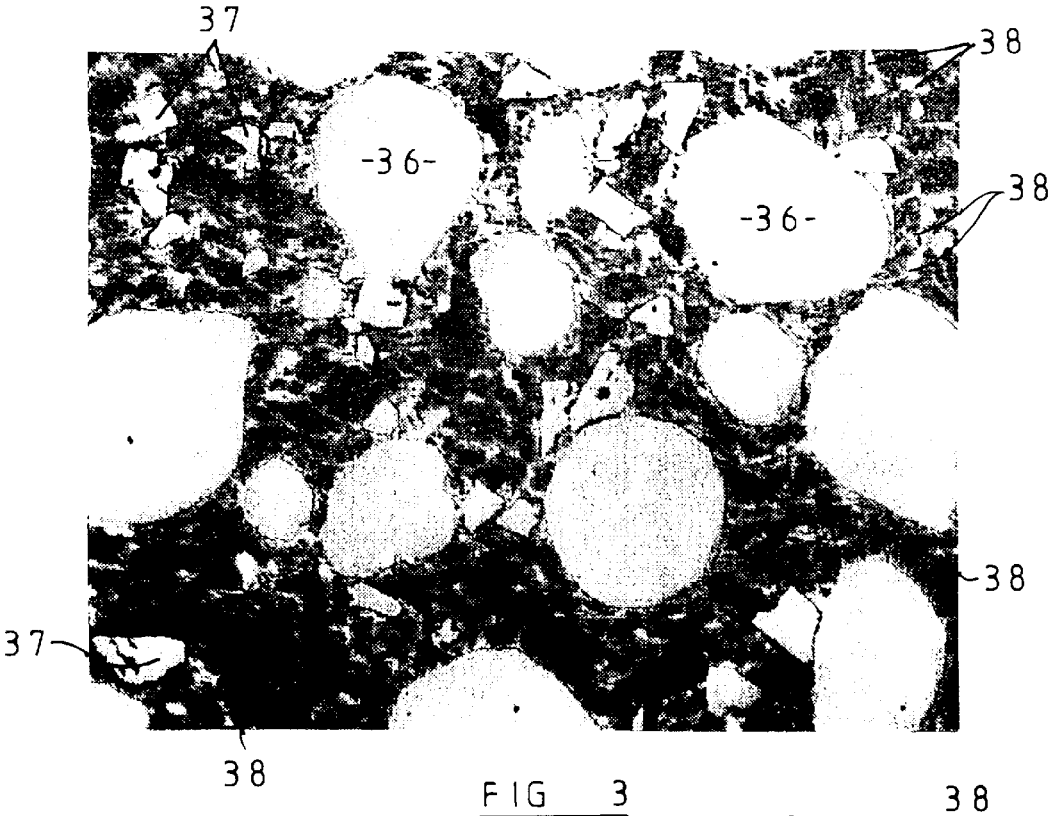
FIG. 3 is a 50× photo-micrograph of the microstructure of the hardmetal inlay of the present invention.

FIG. 2 shows a cross section view of a tooth 30 and the surface 32 of the rolling cutter of a drill bit of the present invention. The hardmetal inlay 34 is shown made into both the tooth 30 and the surface 32 of the rolling cutter. A 50× photo-micrograph of the microstructure of this hardmetal inlay is shown in FIG. 3. The major constituents of the hardmetal inlay are the tungsten carbide and/or tungsten carbide/cobalt hard particles 36, tungsten monocarbide 37, and an alloy steel matrix 38. The steel matrix has a duplex microstructure comprising about 10 to 40 volume percent austenite and 60 to 90 volume percent tempered martensite.

Figure 4:
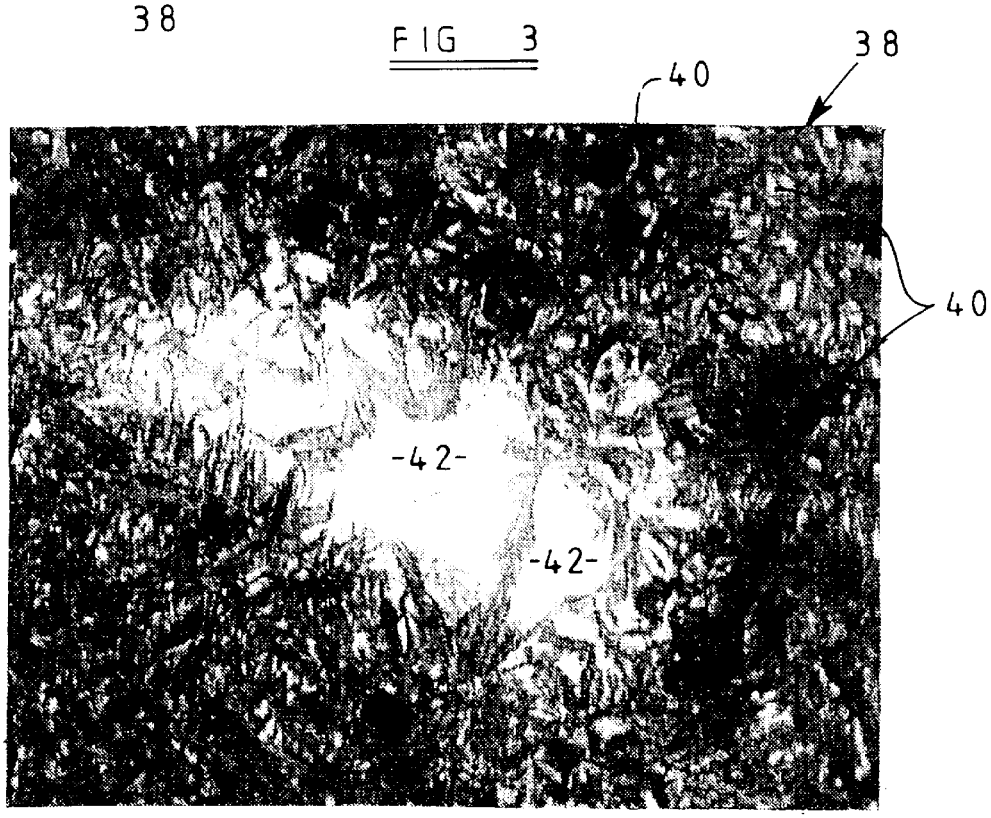
FIG. 4 is a 1250× photo-micrograph of the microstructure of the steel alloy matrix of the hardmetal inlay of the preferred embodiment of the present invention.

As shown in FIG. 4, (a 1250× photo-micrograph of the microstructure of the steel alloy matrix of the preferred embodiment) the steel matrix 38 has a duplex microstructure consisting of 75 to 85 volume percent tempered martensite 40 (the structures which are dark in appearance), and 15 to 25 volume percent austenite 42 (the structures which are light in appearance).

In one form of the preferred embodiment, a RSSDPM hardmetal inlay has a total of 50 volume percent hard phase, made up of 43 volume percent cemented carbide pellets (WC-7.5 wt % Co, 250 to 590 micrometer grain size range) and 7 volume percent tungsten monocarbide (74 to 177 micrometer grain size range); the 50 volume percent matrix would comprise the continuum constituent with a mean free path between hard particles of about 200 micrometers. The duplex matrix microstructure, comprising about 15 to 25 volume percent austenite 42 and 75 to 85 volume percent tempered martensite 40, would reflect an austenite zone size distribution of 1 to 50 micrometers and a mean free path between austenite zones of about 25 micrometers.

In a second form of the preferred embodiment, a RSSDPM hardmetal inlay has a total of 65 volume percent hard phase, made up of 45 volume percent cemented carbide pellets (WC-15 wt % Co, 420 to 590 micrometer grain size range) and 20 volume percent cemented carbide pellets (WC-16 wt % Co, 74 to 177 micrometer grain size range); the 35 volume percent matrix would comprise the continuum constituent with a mean free path between hard particles of about 75 micrometers. The duplex matrix microstructure, comprising about 15 to 25 volume percent austenite 42, and 75 to 85 volume percent tempered martensite 40, would reflect a typical austenite zone size distribution of 0.5 to 40 micrometers and a mean free path between austenite zones of about 20 micrometers.

Under the high stress conditions present at the cutting edge of a drill bit tooth 30, the strain response of a hardmetal inlay containing such a duplex matrix microstructure reflects a relatively high yield strength and a high work hardening rate.

This combination provides excellent support for the hard particles in the composite as well as high apparent toughness. It tends to discourage shear localization by the mechanism of local hardening at high strain contact sites, and by the discontinuity of austenitic ductile regions. The latter effect is concomitant to the inhibition of low strength ferrite halos around WC-Co cemented carbide particles.

Whereas the present invention has been described in particular relation to the drawings attached hereto, it should be understood that other and further embodiments, not shown or suggested herein, may be made within the scope and the spirit of the present invention.

What is claimed is:

1. An earth boring drill bit comprising:

a bit body; and a layer of wear resistant material on a portion of said bit body said layer of wear resistant material comprised of wear resistant particles in a substantially steel matrix, said steel matrix having a duplex microstructure comprising from about 10 to about 40 percent austenite by volume and from about 60 to about 90 percent martensite by volume.

2. The drill bit, as set forth in claim 1, wherein said wear resistant material is integrally formed with said cutter in a rapid, solid state densification powder metallurgy process.

3. The drill bit, as set forth in claim 1, wherein said duplex microstructure is comprised of from about 15 to about 25 percent austenite by volume and from about 75 to about 85 percent martensite by volume.

4. The drill bit, as set forth in claim 1, wherein the austenite is comprised of zones with a size distribution of from about 0.5 to about 50 micrometers.

5. The drill bit, as set forth in claim 1, wherein the austenite is comprised of zones spaced by a mean free path of from about 20 to about 25 micrometers.

6. The drill bit, as set forth in claim 1, wherein the steel matrix includes nickel.

7. The drill bit, as set forth in claim 6, wherein the nickel is in the form of nickel enrichment of the austenite.

8. The drill bit, as set forth in claim 1, wherein the steel matrix includes manganese.

9. The drill bit, as set forth in claim 8, wherein the manganese is in the form of manganese enrichment of the austenite.

10. An earth boring drill bit comprising:

a bit body; and a layer of wear resistant material on said bit body, said layer of wear resistant material comprised of wear resistant particles in a matrix, said matrix having austenitic zones in a martensite continuum.

11. The drill bit, as set forth in claim 10, wherein said wear resistant particles comprise tungsten carbide.

12. The drill bit, as set forth in claim 10, wherein said wear resistant particles comprise tungsten carbide and cobalt.

13. The drill bit, as set forth in claim 10, wherein said austenitic zones comprise about 10 to about 40 percent by volume of said matrix.

14. The drill bit, as set forth in claim 10, wherein said martensite continuum comprises about 60 to about 90 percent by volume of said matrix.

15. The drill bit, as set forth in claim 10, wherein said austenitic zones comprise about 15 to about 25 percent by volume of said matrix.

16. The drill bit, as set forth in claim 10, wherein said martensite continuum comprises about 75 to about 85 percent by volume of said matrix.

17. The drill bit, as set forth in claim 10, wherein the austenitic zones have a size distribution of from about 0.5 to about 50 micrometers.

18. The drill bit, as set forth in claim 10, wherein the austenitic zones are spaced by a mean free path of from about 20 to about 25 micrometers.

19. The drill bit, as set forth in claim 10, wherein the matrix includes nickel.

20. The drill bit, as set forth in claim 19, wherein the nickel is in the form of nickel enrichment of the austenitic zones.

21. The drill bit, as set forth in claim 10, wherein the matrix includes manganese.

22. The drill bit, as set forth in claim 21, wherein the manganese is in the form of manganese enrichment of the austenitic zones.

23. An earth boring drill bit comprising:

a bit body having a protruding member thereon; and a layer of wear resistant material on said protruding member, said layer of wear resistant material comprised of wear resistant particles in a matrix, said matrix having austenitic zones in a martensite continuum.

24. The drill bit, as set forth in claim 23, wherein said wear resistant particles comprise tungsten carbide.

25. The drill bit, as set forth in claim 23, wherein said wear resistant particles comprise tungsten carbide and cobalt.

26. The drill bit, as set forth in claim 23, wherein said austenitic zones comprise about 10 to about 40 percent by volume of said matrix.

27. The drill bit, as set forth in claim 23, wherein said martensite continuum comprises about 60 to about 90 percent by volume of said matrix.

28. The drill bit, as set forth in claim 23, wherein the austenitic zones comprise about 15 to about 25 percent by volume of said matrix.

29. The drill bit, as set forth in claim 23, wherein said martensite continuum comprises about 75 to about 85 percent by volume of said matrix.

30. The drill bit, as set forth in claim 23, wherein the austenite zones have a size distribution of from about 0.5 to about 50 micrometers.

31. The drill bit, as set forth in claim 23, wherein the austenite zones are spaced by a mean free path of from about 20 to about 25 micrometers.

32. The drill bit, as set forth in claim 23, wherein the matrix includes nickel.

33. The drill bit, as set forth in claim 32, wherein the nickel is in the form of nickel enrichment of the austenitic zones of the matrix.

34. The drill bit, as set forth in claim 23, wherein the matrix includes manganese.

35. The drill bit, as set forth in claim 34, wherein the manganese is in the form of manganese enrichment of the austenitic zones of the matrix.

36. The drill bit, as set forth in claim 23, wherein said protruding member comprises a cutting member.

37. The drill bit, as set forth in claim 23, wherein said protruding member supports a cutting member.

38. An earth boring drill bit comprising:

a bit body having a protruding member thereon; and a layer of wear resistant material on said protruding member, said layer of wear resistant material comprised of wear resistant particles in a substantially steel matrix, said matrix having a duplex microstructure comprising from about 10 to about 40 percent austenite by volume and from about 60 to about 90 percent martensite by volume.

39. The drill bit, as set forth in claim 38, wherein said wear resistant particles comprise tungsten carbide.

40. The drill bit, as set forth in claim 38, wherein said wear resistant particles comprise tungsten carbide and cobalt.

41. The drill bit, as set forth in claim 38, wherein said martensite comprises about 75 to about 85 percent by volume of said matrix.

42. The drill bit, as set forth in claim 38, wherein the austenite is comprised of zones with a size distribution of from about 0.5 to about 50 micrometers.

43. The drill bit, as set forth in claim 38, wherein the austenite is comprised of zones spaced by a mean free path of from about 20 to about 25 micrometers.

44. The drill bit, as set forth in claim 38, wherein the steel matrix includes nickel.

45. The drill bit, as set forth in claim 44, wherein the nickel is in the form of nickel enrichment of the austenite of the matrix.

46. The drill bit, as set forth in claim 38, wherein the steel matrix includes manganese.

47. The drill bit, as set forth in claim 46, wherein the manganese is in the form of manganese enrichment of the austenite of the matrix.

48. The drill bit, as set forth in claim 38, wherein said protruding member comprises a cutting member.

49. The drill bit, as set forth in claim 38, wherein said protruding member supports a cutting member.

* * * * *